United States Patent [19]

Jameson

[11] 4,151,924

[45] May 1, 1979

[54] LINER ELEMENT FOR CLOSURE CAP

[75] Inventor: Robert F. Jameson, San Jose, Calif.

[73] Assignee: Owens-Illinois, Inc., Toledo, Ohio

[21] Appl. No.: 849,068

[22] Filed: Nov. 7, 1977

[51] Int. Cl.[2] ..... B65D 41/20; B65D 53/04

[52] U.S. Cl. ..... 215/347; 215/DIG. 2

[58] Field of Search ..... 215/347, 341, DIG. 2; 428/64, 511, 514; 426/127, 129

[56] References Cited

U.S. PATENT DOCUMENTS

| | | | |
|---|---|---|---|
| 2,371,710 | 3/1945 | Schneider | 215/341 |
| 3,633,781 | 1/1972 | Zapata | 215/347 |
| 3,988,521 | 10/1976 | Fumel | 428/511 |
| 4,057,159 | 11/1977 | Fillmore | 215/347 |

FOREIGN PATENT DOCUMENTS

| | | | |
|---|---|---|---|
| 844400 | 8/1960 | United Kingdom | 215/341 |

*Primary Examiner*—Herbert F. Ross

*Attorney, Agent, or Firm*—Richard B. Dence; M. E. Click; D. H. Wilson

[57] ABSTRACT

An improved liner element for a closure cap which is adapted to be disposed within the closure cap and bonded to the interior end surface thereof. The liner element is characterized by having a laminated structure comprising a backing layer or cushion layer of surface-sorbent material, such as fabric, a relatively thin sheet of paper or comparable surface-sorbent cellulosic or paper-like membrane or substrate, having an inner face which is surface-bonded to the interior end surface of the closure and having an outer face which is surface-bonded to a barrier layer of pliant polymeric material. The barrier layer of polymeric material is selected to possess the properties of being essentially impermeable to water vapor and gaseous transmission so as to be suitable for closure caps utilized in conjunction with containers for packaging comestible products and carbonated or non-carbonated, alcoholic and non-alcoholic beverages. Additionally, the barrier layer is selected to be inert with respect to the container's contents to avoid impairment or alteration of the color, flavor or quality characteristics of the contents of the container. In a preferential alternative aspect, the selected barrier layer is also an essentially transparent polymeric material and the outer surface of the backing layer is receptive to the application of marking materials, such as inks or the like so as to accommodate distinctively applied markings which are visibly discernible through the barrier layer.

7 Claims, 3 Drawing Figures

LINER ELEMENT FOR CLOSURE CAP

BACKGROUND OF THE INVENTION

1. Field of the Invention

The present invention pertains to liner elements for closure caps utilized for hermetically sealing bottles, jars and like containers employing removable closure members to hermetically seal the dispensing end of the container. More particularly, the invention relates to an improved liner element which provides greater versatility in the selection of various polymeric liner materials which may be compatibly employed with and bonded to various types of closure caps, regardless of the types of material from which such caps are fabricated, such as aluminum, tin or chrome-plated steel, plastic or the like. In other more particular respects, the present invention also relates to an improved liner element which is adapted to carry distinctive or promotional markings, logos, color patterns, emblems, designs and messages so that upon removal of the closure cap from a container such markings may be visibly discernible within the cap without necessitating prior removal of the liner element from within the closure cap.

2. Description of the Prior Art

In the packaging of various comestibles and beverages in bottles, jars and like containers, it has become conventional practice to utilize closure caps having a pliant, protective sealing liner covering the interior end surface of the closure cap. Upon tightly securing the closure cap onto the dispensing end of its intended container, the liner is designed to press tightly against and yieldably conform to the surface configuration of the dispensing end of the container to thereby form a protective hermetic seal capable of maintaining the container's contents in a flavorful and wholesome condition until such time as consumption of the container's contents is desired. Such types of closure caps are, of course, well-known and commonly have outer shells fabricated from such materials as aluminum, tin or chrome-plated steel, and plastic. Typically, the entire interior surfaces of such closure caps, and particularly those fabricated from aluminum and tin or chrome-plated steel, are overcoated with an organic lacquer or varnish film coating which is heated to form a tough, baked-on film of organic sizing material. Among other well-known sizing materials commmonly employed for such purposes are solvent-containing vinyl phenolic coatings, and modified polyvinyl chloride coatings, such as, for example, vinyl chloride/vinyl acetate copolymers having an oleoresinous modifier, such as a tung oil modified phenol-formaldehyde, dissolved in a suitable heat dissipatable solvent; the latter coating material being described in U.S. Pat. No. 3,411,650. These specifically mentioned sizing materials have been found to be especially suitable since they not only adhere tenaciously to the interior surfaces of both aluminum and tin and chrome-plated steel closure caps, but also provide sidewall surface lubricity which reduces the manual torque required in removing threaded or similar twist-off types of closure caps from containers. No less significantly, these various vinyl phenolic and modified polyvinyl chloride sizing compositions have been found to be an exceptionally effectual and compatible bonding media for heat-bonding to commonly employed plastisol sealing liners.

In the past, commonly employed plastisol sealing liners have customarily included vinyl, and particularly vinyl or vinylidene chloride, as constituent components of the liner composition. Moreover, while these plastisol liner materials have achieved substantial commercial acceptance as an effective hermetic liner material, substantial interest has been expressed by the packaging industry, as well as the United States Federal Food and Drug Administration, in the development of alternative hermetically sealable liner materials which are compatible with packaged products intended for human consumption. Among other advantages, the development of alternative liner materials provides the promise of less restricted material supply sources and reduced material cost. Additionally, such alternative liner materials offer the capability of greater versatility of liner properties and characteristics so that the liner materials may be better tailored to the particular packaging needs or requirements desired. Consequently, intensified efforts have been directed towards the formulation and development of commercially feasible, alternative closure liner materials which, in addition to possessing the hermetic sealability characteristics of plastisol liner materials heretofore commonly utilized, also possess a highly acceptable degree of compatibility with comestible products and beverages with which they may be employed for packaging purposes.

For various reasons, however, many of the newly developed liner materials have been found to be unsuitable for use with conventional aluminum or plated steel closure caps since they do not effectively bond with the conventionally employed sizing materials employed on the interior surfaces of such closure caps, and thus cannot be securely bonded or retained within the closure caps. Without such secure retention within the closure, seal failure is likely to result as a consequence of displacement of the liner within or from the closure cap. For example, among others, copolymers of ethylene/vinyl acetate have been found to possess properties of inertness, durability and hermetic sealability which are known to render them especially suitable as liner materials for a diverse variety of comestibles and carbonated beverages. Unfortunately, however, as with various other newly developed liner materials, these ethylene/vinyl acetate copolymers possess properties which preclude the formation of an effective bond to conventional sizing materials commonly applied on the interior surfaces of aluminum and plated steel closure caps. Thus, a great need exists for the development of an effective means of achieving a bonding compatibility between aluminum and plated steel closures utilizing conventional sizing materials and various newly developed polymeric liner materials such as, for example, the previously mentioned liner materials fabricated from ethylene/vinyl acetate copolymers.

More recently, both aluminum and chrome and tin-plated steel closures of the threaded, or twist-off, variety have achieved substantial market acceptance as convenience closures for various types of beverage bottles, and similar containers, used for packaging both carbonated and non-carbonated beverages. In the manner previously described, these convenience closures are likewise conventionally interiorly coated with a baked-on sizing composition to which conventional plastisol types of liners are heat-bonded and provide a hermetic seal to protect the flavor, wholesomeness and carbonation, if any, of the packaged beverage. Particularly in the soft-drink industry, there has been a sizeable trend and persuasive commercial interest in providing a convenience closure in which the interior of the closure is provided with distinctive markings, logos, symbols, color patterns, emblems or other various designs or messages which are visually discernible within the closure cap after its removal from a container. Such markings are frequently applied for aesthetic or promotional purposes. Also, closures containing such interior markings are suitable for use as children's trading items or as tokens which are redeemable for valuable prizes and gifts. In brief, closures provided with such interior designs, markings, or the like, are commercially desirable factors capable of influencing an increased market demand for various products, and particularly non-alcoholic beverages and soft-drinks which are in great demand and consumed in substantial quantities by children and adults alike.

In the past, attempts to provide closure caps having interior markings, logos, designs, etc. have ordinarily been difficult and costly and have necessitated the application of such markings, etc. directly upon the metal portion of the closure or upon the closure sizing composition so that they appear on the interior end surface of the closure prior to application of the plastisol liner material, which in such instances is selected to possess substantial transparency after curing. Alternatively, attempts have been made to apply such markings, designs, etc. on the unexposed surface of the plastisol liner material which is to be bonded to the closure. In either event, the application of such markings to either the bare or sized metal surface of the closure or to the surface of the liner material entails an inordinately time-consuming and costly manufacturing operation. Due to the lack of surface absorbency of aluminum and plated steel, application of the selected printing ink, enamel, or other marking medium directly onto the unsized metal requires prolonged drying times and/or elaborate drying techniques and equipment. Moreover, to provide multiple color applications, each color must ordinarily be separately dried prior to the application of another color. On the other hand, in the event that the sizing composition is applied to the metal prior to application of the marking or printing medium; then, a delicate tailoring or match of drying and baking temperatures is required in order to properly dry the marking or printing medium and to properly bake the sizing composition on the metal. Moreover, if multiple color application is desired, even more time-consuming and complex temperature coordinated drying and baking procedures are necessitated. Alternatively, if the printing or coloring medium is applied directly to the surface of the liner material, as is customary, while the liner material is in sheet form, exacting registration and orientational problems are encountered to ensure proper subsequent location of the marking, logo, etc. within the closure cap. No less importantly, the residual unused portions of the sheet of liner material, from which the individual liner members are stamped out or otherwise removed, is ordinarily salvaged for reuse and thus is subject to objectionable contamination by the marking medium during subsequent reprocessing and reconsolidation of the salvaged material into reusable sheets of liner material.

SUMMARY OF THE INVENTION

In one of its broader aspects, the present invention pertains to an improved liner element for imparting hermetic sealing characteristics to a closure cap. In more specific respects, the particular liner element of the present invention constitutes a laminated structure comprising a barrier layer of pliant polymeric material and a backing layer, or cushion layer, of surface-sorbent material. By virtue of such laminated construction, the liner element offer versatility in the selection and utilization of liner elements having barrier layers formulated from a variety of different polymeric materials, which although possessing superior hermetic sealing capabilities and excellent compatability with packaged comestible products and beverages over prolonged periods of time, have not, so far as is known, been suitable or compatible for use as liner materials for conventional aluminum or plated steel closure caps. In brief, the backing layer, or cushion layer, of surface-sorbent material is preferably a relatively thin sheet of paper, or comparable surface-sorbent cellulosic or paper-like membrane or substrate. The outer face, or surface, of the backing layer which faces towards the container is surface-bonded to the selected barrier liner by a coating, or adhesive, which is selected to be compositionally compatible to bond the barrier layer to the backing layer. Such coatings, or adhesives, depending upon the polymeric material selected, are well-known and are frequently compositionally akin to the selected polymer liner material utilized for the barrier layer. On the other hand, the opposite inner face, or surface, of the surface-sorbent backing layer is bonded to the interior end surface of the closure cap. Ordinarily, the cellulosic constituents, or components, in the backing layer are directly heat-bondable with the conventional sizing materials employed on the interior surface of the closure. However, if desired, a compatible adhesive or bondable coating material may be employed to bond the inner face of the backing layer to the interior end surface of the closure cap. Thus, various desirable polymeric liner materials may be employed without dependency upon the capability, or compatibility, of the polymeric liner material of the barrier layer to bond to the interior end surface of the closure cap.

In accordance with another aspect of the present invention, the laminated structure of the liner element also renders it readily adaptable to economically accommodate on the outer face of the surface-sorbent, backing layer, the application of various distinctive and decorative markings, logos, symbols and multiple-color representations by means of conventional high-speed, single or multiple-color printing, or lithographic or other transfer printing techniques and, if desired. the employment of quick-drying, printing inks, or the like. Over the distinctively marked, or decorated, backing layer, a barrier layer of transparent, or substantially transparent, polymeric liner material may be bonded so that the markings, or decorative material, although protectively isolated from contact with a container's contents, may be visually observed when the closure cap is viewed interiorly following its removal from a container. Thus, the liner element of the present invention also permits it to be advantageously utilized in a closure cap for promotional purposes. As a further feature, the backing layer of the liner element is adaptable to being preferentially separable from the closure so that the liner element may be, under the influence of manual force, separated and removed from the closure without defacing the applied marking or decoration and without tearing or separating the inner face of the backing layer from the barrier layer of polymeric material. Thus, when desired, the liner element may be applied in the closure in such manner that it may be removed essentially intact from the closure and thus avoid necessitating retention of the entire closure cap.

Accordingly, it is a principal objective of the present invention to provide a liner element for a closure cap in which the liner element is structured in such manner that various polymeric liner materials may be alternatively, or optionally, employed with conventionally employed closure caps to provide durable hermetic seals for bottles, jars and similar containers, without necessitating specially formulated sizing compositions to provide adequate bonding between the liner element and closure cap.

Another objective of the present invention is the provision of a closure cap containing a liner element which is characterized by having a laminated structure comprising a backing layer, or cushion layer, of surface-absorbent material having an inner face surface which is surface-bondable to the interior end surface of a metallic closure cap and having an opposite outer face surface which is surface-bonded to a barrier layer of polymeric liner material capable of forming a hermetic seal with the dispensing end of a container designed to accommodate the closure cap.

Another objective of the present invention is the provision of a liner element embodying the characteristics of the last-mentioned objective, and which also includes the provision of a polymeric liner material which is substantially transparent and the provision of a distinctive marking, color pattern, logo, symbol, or the like, on the outer face surface of the backing layer which is visibly discernible through the polymeric liner material.

A further, but no less important, objective of the present invention is the provision of a liner element embodying the characteristics of the first-mentioned objective, and wherein the polymeric liner material is a material which is incapable of being heat-bonded directly to the interior surface of the closure cap.

A more particular objective of the present invention is the provision of a liner element for a metallic closure cap having the interior surfaces thereof coated with a baked-on conventional sizing material; the liner element being characterized by having a composite laminated structure including an ethylene/vinyl acetate copolymer providing a hermetic barrier layer which is essentially impermeable to gases and water vapor and which is inert when exposed to packaged comestible products and beverages, and further characterized by having a backing layer of surface-sorbent material, such as paper or other cellulosic or paper-like material with an outer face, or surface, selectively bonded to the barrier layer and having an inner face, or surface, selectively bonded to the baked-on sizing on the interior end surface of the closure cap.

A further objective of the present invention is the provision of a closure cap embodying the characteristics of each of the last two objectives and which further features the provision of a visibly distinctive marking or representation displayed on the outer surface of the backing layer, and the provision of a barrier layer of sufficient clarity to permit visible recognition of such marking or representation when viewed through the barrier layer.

A still further and more particular objective of the present invention is the provision of a closure cap embodying the last-mentioned characteristics and wherein the backing layer is adapted to preferentially separate from the interior end surface of the closure cap rather than the barrier layer in response to forceful manual removal of the liner element from the closure cap.

The specific nature of the present invention, together with the foregoing and other additional objectives, features and advantages thereof, will become readily apparent to those ordinarily skilled in the art from the following detailed description taken in conjunction with the annexed sheets of drawings on which, by way of illustrative example, certain preferred embodiments of the present invention are depicted.

Figure 1:
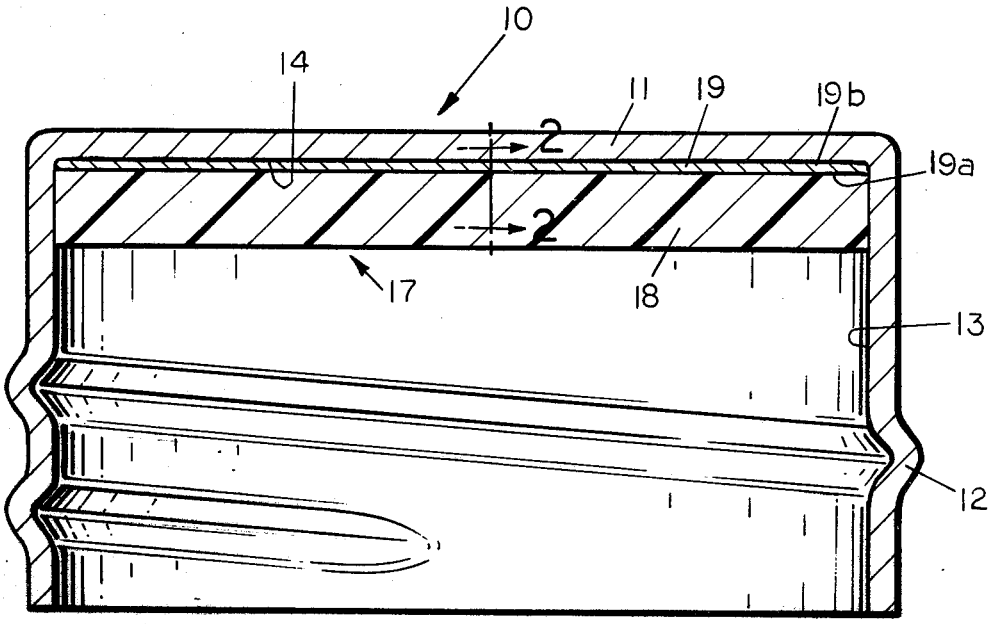
FIG. 1 is a substantially enlarged view in cross-sectional elevational aspect of a closure cap containing a liner element embodying the features of the present invention.
Figure 2:
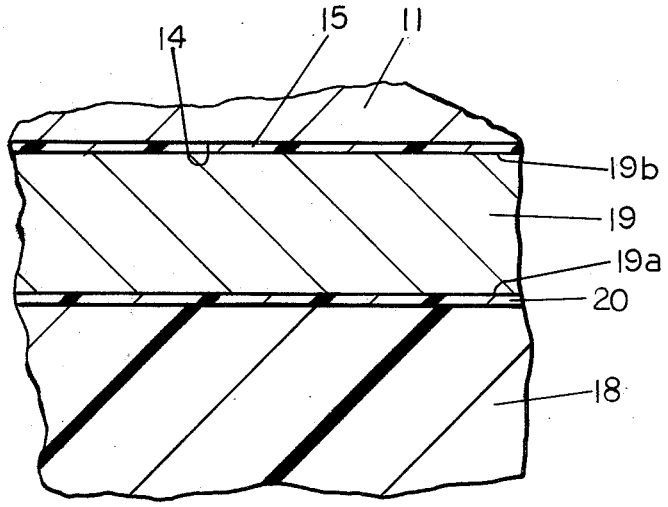
FIG. 2 is a greatly magnified fragmentary enlargement of a section of the closure cap taken along and in the direction of the sectional plane 2—2 in FIG. 1, and more clearly depicting certain structural characteristics of the invention.

With reference to the drawings, in FIG. 1 there is generally shown, in elevational cross-section, a closure cap 10, which is preferentially depicted as a convenience-type closure having a conventional, cup-shaped outer shell comprising a central end panel forming a closed end portion 11 carrying an integral, female-threaded, hollow, peripheral skirt portion 12. Applied to the interior sidewall and endwall surfaces 13 and 14, respectively, there is, as shown in FIG. 2, a surface film or coating of an organic sizing material 15.

Carried within the closure cap 10 there is a liner element, which is generally designated as 17, and which is a laminated structure comprising a barrier layer 18 of pliant polymeric material bonded to a cushion layer, or backing layer 19, of surface-sorbent material.

In conventional manner, the outer shell of the closure may be fabricated from any plastic, metallic or other material suitable for such purpose, but is preferably fabricated from aluminum or tin or chrome-plated steel of the type widely used for the fabrication of threaded closure caps commonly employed with beverage bottles, and particularly the larger family-size beverage bottles and containers. As is customary with closure cap shells fabricated from light-gauge aluminum or tin or chrome-plated steel sheet material, the surface of the metallic sheet material which ultimately forms the interior end wall and sidewall surfaces 13 and 14 of the closure cap is ordinarily overcoated with a thin coating or film of baked-on organic sizing material 15, which is sometimes referred to as an organic lacquer or varnish coating. The film of sizing material commonly functions to impart surface lubricity as well as protective isolation to the metal surface. The increased lubricity aids both in the initial shaping of the cap shell and in providing a reduction in the frictional torque ultimately required to thread the closure cap onto or off of a container. The protective isolation of the metal is for the purpose of protecting the interior metallic surfaces of the closure cap from the potentially corrosive effects of certain comestible and beverage products which may be packaged in the containers on which the closure caps are applied. Such sizing materials are well-known in the closure manufacturing industry and are variously described in several United States patents. For example, such a sizing material is described in U.S. Pat. No.

3,131,081 as being a vinyl phenolic copolymer having a thickness of about 0.0005 inch. Another such sizing material is described in U.S. Pat. No. 3,411,650 as being a lacquer coating of vinyl chloride/vinyl acetate copolymer having an oleoresinous modifier, such as tung oil modified phenolformaldehyde, dissolved in a suitable solvent. A common characteristic of these and other conventional and commonly employed sizing materials is that they are essentially always a form of vinyl chloride or modified vinyl chloride containing material and possess the capability of being applied together with a suitable solvent as a thin film on the metallic surface and thereafter heat-hardened to form a protective, baked-on coating, or film, which is extremely adherent to the metal surface. Although these commonly employed sizing materials are heat-bondable or otherwise directly adherent with many types of commonly employed polymeric liner materials such as, for example, polymerized poly(vinyl chloride) materials, such bondability is extremely difficult to obtain or is essentially unobtainable with many other types of polymeric materials which possess properties highly suitable for use as closure liners for hermetic sealing of various comestible and beverage products.

In accordance with the present invention, the difficulties and problems experienced in attempting to bond various polymeric materials, which are highly desirable or suitable candidates for use as hermetically sealable liner materials for closure caps, are effectively overcome by means of the novel laminated liner element 17. In this regard, the cushioning layer, or backing layer 19, which is shown in the form of a thin disk, membrane, or substrate of a surface-sorbent material, has an inner face, or inner surface **19*b*, which is adapted to bond to the film or coating of sizing material 15, which, in turn, is bonded directly to the interior endwall surface 14 of the closure cap. The opposite outer face, or outer surface 19*a*, of the backing layer 19, on the other hand, is laminated, or bonded, to the surface of the barrier layer 18. Thus, the backing layer 19 functions as an intercessor layer which is bondable to both the film of sizing material 15 and the barrier layer 18**.

The backing layer 19 is, as mentioned, a surface-sorbent material which is capable of having the opposite outer and inner surfaces **19*a* and 19*b* impregnated, if desired, with adhesive coating compositions which are bondable with the backing layer 19 as well as with the particular sizing material 15 and the particular polymeric liner material forming the barrier layer 18. Typically, the backing layer 19** may be a surface-sorbent cloth or paper fabric which is not subject to deterioration or degradation by contact with or exposure to the adhesive coating compositions, sizing material or polymeric barrier layer material with which it is associated. Preferably, the backing layer is composed primarily of a cellulosic substance, such as paper or a comparable paper-like substance.

The barrier layer 18 may be composed of most any available polymeric material which possesses the desired properties suitable for liner use in closure caps. In the event the liner element 17 is intended for use in packaging food or beverage products, however, the polymeric material typically should exhibit excellent durability, nondegradability, impermeability to water vapor and essentially all gaseous substances. Moreover, it should possess the requisite property of being essentially inert even when subjected to prolonged contact or exposure to the food or beverage product with which it is to be used. A polymeric barrier layer material found to be particularly preferred is an ethylene/vinyl acetate copolymer which, among other commercial sources, is commercially available from U.S. Industrial Chemicals Co., located at P. O. Box 218, Tuscola, Illinois 61953, under the product designation NA 294-00, and which is listed as an approved substance for closure sealing gaskets for food containers so long as it is not used to hold or contact food products during cooking.

Although the overall thickness of the liner element of the present invention may vary considerably depending upon the structural and dimensional characteristics of the closure cap and the container and product with which it is to be used, an overall thickness in the range of between about 0.020 and 0.040 inch is ordinarily desirable. Consonant with an overall thickness range of between about 0.020 and 0.040 inch for the laminated liner element, the barrier layer 18 and the backing layer 19 preferably will possess thicknesses in the respective ranges of between about 0.025–0.035 inch and between about 0.002–0.008 inch.

Figure 3:
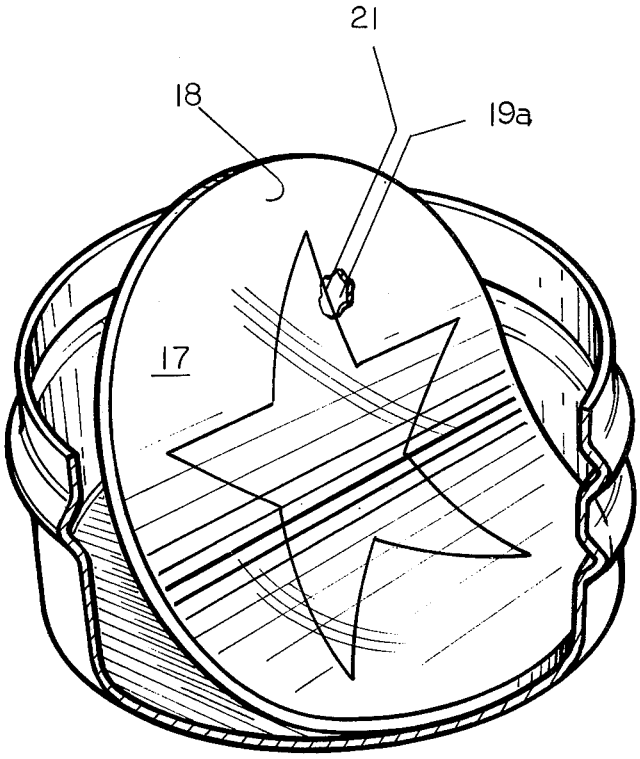
FIG. 3 is a perspective view looking towards the interior of a closure cap containing a liner element partially peeled away from the closure cap and embodying an alternative feature of the present invention.

A further advantageous feature of the present invention is depicted in FIG. 3, wherein the outer surface **19*a* of the backing layer of the liner element 17 is decoratively printed with a visibly discernible marking 21. Although the marking 21 is illustratively shown as a star, it will be understood that the surface-sorbent characteristics of the backing layer render it suitable for the application of various types of printing inks and marking media including rapid drying multi-color inks, and the like. As shown, the barrier layer 18 is composed of a transparent polymeric material which permits the marking to be readily observed when the closure cap is disassociated from a container. Also, as shown, the liner element 17 is partially peeled or stripped away from the interior end surface of the closure cap to illustrate the added capability of being able to render the backing layer 19 preferentially separable from the interior end surface of the closure cap. Such preferential separability permits the backing layer 19 and the barrier layer 18 portions of the liner element to be manually removed as an integral laminated unit without defacing or impairing the distinctive marking 21 appearing on the outer surface 19*a* of the backing layer. Hence, the liner element 17** is exceptionally suitable for use in displaying logos, slogans, or promotional features. For example, the marking upon the backing layer may be selected to signify the availability of a prize, with the prize being conditional upon return of the liner element.

The preferential separability of the backing layer is readily accomplished by providing a more tenacious bond between the outer surface **19*a* of the backing layer and the barrier layer than is provided between the inner surface 19*b* of the backing layer and the interior endwall surface 14** of the closure cap. The bonding capabilities of various suitable and readily available adhesive and bonding compositions are well-known in the art and may easily be selected to achieve the desired preferential separability, or bonding, of the backing layer.

As a typical example, a backing layer of 60 pound litho stock paper having a multicolor logo printing on the outer surface and overcoated with a conventional 0.001 to 0.002 inch thick polyvinyl adhesive coating material was surface-bonded to an essentially transparent 0.025 inch thick poly (vinyl chloride) liner material to form a disk-shaped laminated liner element, such as the liner element shown and described above. The uncoated inner surface of the paper backing layer was then heat-bonded at a temperature of approximately 375° F.

to the sizing material on the interior endwall surface of a conventional, beverage type aluminum convenience closure. The laminated liner element bonded quite securely to the sizing material, but was capable of being intentionally pried away from the interior endwall without separation occurring between the polymeric barrier layer and the paper backing layer. Moreover, the surface printing on the outer surface of the backing layer was unimpaired and clearly observable through the barrier layer. Similar results were also achieved with a barrier layer of transparent ethylene/vinyl acetate copolymer bonded to a paper bacing layer by means of a polymerizable ethylene/vinyl acetate coating applied on the outer surface of the paper backing layer.

It will, of course, be understood that various details of construction, combination and assembly may be modified throughout a range of equivalents, and it is, therefore, not the purpose to limit the scope of the present invention otherwise than as necessitated by the scope of the appended claims.

I claim:

1. A laminated liner element for a closure cap, said liner element comprising:

a barrier layer of pliant polymerized ethylene/vinyl acetate copolymer material possessing the properties of being essentially impermeable to water vapors and gaseous substances;

a backing layer of surface-sorbent material selected from the group comprising cloth fabric, cellulosic material, paper or paper-like material and having an outer face surface-bonded to said barrier layer, and having an inner face adaptable to be bonded to the interior endwall surface of said closure cap.

2. A laminated liner element as defined in claim 1, wherein said barrier layer is essentially transparent.

3. A laminated liner element as defined in claim 2, wherein said outer face includes a distinctive marking applied thereon, and wherein said marking is visibly discernible through said barrier layer.

4. A laminated liner element as defined in claim 3, wherein said backing layer is adapted to bond less tenaciously to said interior endwall surface of said closure cap than to said barrier layer, whereby said backing layer will preferentially separate from said interior endwall surface and accompany said barrier layer in response to forceful removal of said liner element from said closure cap.

5. A laminated liner element as defined in claim 1, wherein said barrier layer possesses a thickness in the range of between about 0.025 and 0.035 inch, and wherein said backing layer possesses a thickness in the range of between about 0.002 and 0.008 inch.

6. In a closure cap for establishing and maintaining hermetic sealability against the dispensing end of a bottle, said closure cap including an interior endwall and sidewall surface, an organic sizing material bonded to and coextensive with said endwall and sidewall surface and a laminated liner element, the improvement wherein said liner element comprises:

a backing layer of surface-sorbent material selected from the group comprising cloth fabric, cellulosic material, paper or paper-like material and having an inner face confronting and bonded to the sizing material on said endwall surface, and having an oppositely facing outer face, and a barrier layer of pliant polymerized ethylene/vinyl acetate copolymer material possessing the properties of being substantially transparent and essentially impermeable to water vapors and gaseous substances, said barrier layer being surface-bonded to the outer face of said backing layer, and a distinctive marking applied on said outer face of said surface-sorbent material and being visibly discernible through said barrier layer.

7. A closure cap as defined in claim 6, wherein the bond between the inner face of said backing layer and the sizing material is preselectively weaker than the bond between said barrier layer and the outer face of said backing layer, to thereby selectively accommodate forceful separation of said backing layer from said closure cap without impairing the distinctive marking on the outer face of said backing layer and without impairing the bond between said backing layer and said barrier layer.

* * * * *